US007246382B2

(12) United States Patent
Plut et al.

(10) Patent No.: US 7,246,382 B2
(45) Date of Patent: Jul. 24, 2007

(54) HANDWEAR THAT IMPROVES PROTECTIVE APPAREL DOFFING

(75) Inventors: William J. Plut, Menlo Park, CA (US); Timothy Ormond, Aurora (CA)

(73) Assignee: Cylena Medical Technology, Inc., Toronto (CA)

( * ) Notice: Subject to any disclaimer, the term of this patent is extended or adjusted under 35 U.S.C. 154(b) by 208 days.

(21) Appl. No.: 11/029,661

(22) Filed: Jan. 4, 2005

(65) Prior Publication Data

US 2005/0204451 A1 Sep. 22, 2005

Related U.S. Application Data

(60) Provisional application No. 60/535,422, filed on Jan. 9, 2004.

(51) Int. Cl.
*A41D 19/00* (2006.01)

(52) U.S. Cl. ..... 2/161.6; 2/59; 223/111

(58) Field of Classification Search ..... 2/59, 2/161.1, 161.6; 223/111, 112, 113
See application file for complete search history.

(56) References Cited

U.S. PATENT DOCUMENTS 4,228,935 A 10/1980 Madray
4,384,370 A 5/1983 Singer
4,504,978 A 3/1985 Gregory, Jr.
4,683,593 A 8/1987 Langley
4,915,272 A 4/1990 Vlock
4,937,881 A 7/1990 Heise
4,999,849 A * 3/1991 Grilliot et al. ..... 2/123
5,073,988 A 12/1991 Lewis, Jr.
5,236,769 A 8/1993 Paire
5,349,705 A 9/1994 Ragan
5,444,871 A 8/1995 Lopez
5,467,481 A 11/1995 Srivastava
5,568,955 A 10/1996 Giuliano
5,572,743 A 11/1996 Yavitz
5,588,153 A 12/1996 Ignon
5,588,155 A 12/1996 Baker
5,594,955 A 1/1997 Sommers
5,628,067 A 5/1997 Meyer
5,655,374 A 8/1997 Santilli
5,680,653 A 10/1997 Mathis
5,693,401 A 12/1997 Sommers
5,704,670 A 1/1998 Surplus
5,724,674 A 3/1998 Covington
5,734,992 A 4/1998 Ross
5,799,333 A * 9/1998 McGarry et al. ..... 2/161.6
5,806,099 A 9/1998 Grinberg
5,816,440 A 10/1998 Shields
5,822,796 A 10/1998 Harges
5,853,395 A * 12/1998 Crook et al. ..... 604/174
5,924,130 A 7/1999 Fragomeli
5,961,167 A 10/1999 Gilley
5,991,921 A 11/1999 Saito
6,058,882 A 5/2000 Leutholt (Continued)

*Primary Examiner*—Katherine Moran

(57) ABSTRACT

Described herein are systems and methods that facilitate doffing of protective apparel. The systems and methods employ handwear worn under a glove, such as a disposable fingered glove. The handwear is designed or configured such that when a user doffs the handwear and outer glove, the handwear restrains the glove. When a user pulls the handwear and outer glove inside-out, the inside-out handwear may contain and capture portions of the glove, which reduces exposure by the person to the previously outer (and contaminated) surfaces of the glove.

20 Claims, 8 Drawing Sheets

U.S. PATENT DOCUMENTS 6,115,839 A 9/2000 Covington
6,115,850 A * 9/2000 Grilliot et al. ..... 2/457
6,122,772 A 9/2000 De Guzman
6,241,134 B1 6/2001 Dunkel
6,279,792 B1 8/2001 Neal
6,360,373 B1 3/2002 Rehn
6,370,694 B1 4/2002 Michelson
6,393,617 B1 5/2002 Paris
6,427,883 B1 8/2002 Esten
6,442,761 B1 9/2002 Huang
6,481,019 B2 11/2002 Diaz
6,516,469 B1 2/2003 Schaetzel
6,530,090 B1 3/2003 Ambrose
6,543,642 B1 4/2003 Milliorn
6,554,168 B2 4/2003 Stobart
6,557,178 B1 5/2003 Hoover
6,594,830 B2 7/2003 Geng
6,618,861 B2 9/2003 Saks
6,643,846 B2 11/2003 Turner-Antonsen
6,665,880 B2 12/2003 Poppe
6,708,840 B2 3/2004 Grinberg
6,810,530 B2 * 11/2004 Bryant, Sr. ..... 2/159

* cited by examiner

HANDWEAR THAT IMPROVES PROTECTIVE APPAREL DOFFING

CROSS-REFERENCE TO RELATED APPLICATIONS

This application claims priority under 35 U.S.C. §119(e) from now abandoned U.S. Provisional Patent Application No. 60/535,422, filed Jan. 9, 2004 which is incorporated by reference in its entirety for all purposes.

BACKGROUND OF THE INVENTION

This invention relates to protective apparel. More particularly, the present invention relates to systems and methods that facilitate doffing of protective apparel including gloves.

Protective apparel is used in many environments that offer an undesirable chemical or biological agent. Medical practitioners frequently operate on a patient who carries a communicable disease. Recent worldwide outbreaks of severe acute respiratory syndrome (SARS) have required health care practitioners to interact with patients that are knowingly afflicted. Practitioners in medical environments such as this are prone to contamination from airborne, blood-borne and droplet-transmitted biological agents. Industrial and chemical environments also offer a variety of airborne, liquid and solid hazards.

Many individuals wear protective apparel to defend from an undesirable agent. Full body suits are common, as are open-bottom gowns that provide frontal coverage and include sleeves to protect the wearer's arms. Gloves, such as disposable latex gloves, are regularly worn with protective apparel. Some practitioners tape the disposable gloves to the apparel sleeves to maintain glove position during usage.

When doffing, conventional apparel users are susceptible to cross-contamination. Cross-contamination occurs when a contaminated part of the apparel contacts an unprotected portion of a person's skin or clothes. Sequential removal of separate apparel parts may lead to circumstances that pose cross-contamination risks. For example, doffing gloves commonly leads to removal and handling of a contaminated second glove by a bare hand. Subsequently, the cross-contaminated hand may be inadvertently used to rub an eye, nose or mouth. Cross-contamination during doffing significantly increases practitioner exposure to the undesirable agent.

Based on the foregoing, it should be apparent that alternative protective apparel and methods for doffing protective apparel would be desirable.

SUMMARY OF THE INVENTION

The present invention relates to systems and methods that facilitate doffing of protective apparel. The systems and methods employ handwear worn under a glove, such as a disposable fingered glove. The handwear is designed or configured such that when a user doffs the handwear and outer glove, the handwear restrains the glove. When a user pulls the handwear and outer glove inside-out, the inside-out handwear may contain and capture portions of the glove, which minimizes exposure by the person to the previously outer (and contaminated) surfaces of the glove.

In one embodiment, a user pulls the handwear inside-out during doffing along with any attached portions of the protective apparel (such as a sleeve) and an outer glove worn over the handwear. Afterwards, the handwear is inside-out and the outer glove is restrained by the inside-out handwear.

This inside-out doffing may a) contain the outer glove at least partially within the inside-out handwear, b) turn some or all of the previously outer surfaces of the glove inside-out, and c) reduce the chances for contact between the person and previously outer glove surfaces that were potentially exposed to an undesirable agent during apparel usage. The sleeve may also be pulled inside-out. Pulling the sleeve inside-out also reduces the likelihood of contact between the person and previously outer surfaces of the sleeve that were potentially exposed to an undesirable agent.

In one aspect, the present invention relates to a method of doffing protective apparel. The method comprises wearing a fingered glove over handwear. The handwear is attached to a distal portion of a sleeve that covers at least a portion of an arm of a person. The handwear includes material designed or configured to fit between two adjacent fingers of the person when the person wears the handwear. The method also comprises withdrawing a hand from the handwear and from the glove. The method further comprises turning at least a portion of the handwear inside-out. The method additionally comprises restraining a portion of the glove using the handwear.

In another aspect, the present invention relates to a method of doffing protective apparel. The method comprises wearing a fingered glove over handwear. The method also comprises pulling the handwear within the sleeve. The method further comprises withdrawing a hand from the handwear and from the glove. The method additionally comprises turning at least a portion of the handwear inside-out. The handwear includes material designed or configured to fit between two adjacent fingers of the person when the person wears the handwear. The method also comprises restraining a portion of the glove using the material designed or configured to fit between two adjacent fingers.

In yet another aspect, the present invention relates to a method of doffing protective apparel. The method comprises wearing a fingered glove over handwear. The method also comprises withdrawing a hand from the handwear and from the glove. The method further comprises turning at least a portion of the handwear inside-out. The method additionally comprises restraining a portion of the glove using the handwear and material included in the handwear that is designed or configured to fit between two adjacent fingers when the handwear portion is inside-out.

In still another aspect, the present invention relates to a system for improved doffing of protective apparel. The system comprises a sleeve that is designed or configured to receive at least a portion of an arm of the person when the person wears the apparel. The system also comprises handwear attached to a distal portion of the sleeve. The handwear includes material designed or configured to fit between two adjacent fingers of the person when the person wears the handwear. The handwear also includes multiple finger receptors. Each finger receptor comprises an aperture and is designed or configured to receive a finger of the person through the aperture when the person wears the handwear. Each finger receptor is further designed or configured such that a tip of the finger is not covered.

In another aspect, the present invention relates to protective apparel. The protective apparel comprises a body portion that is designed or configured to cover at least a portion of the person's torso when the person wears the apparel. The protective apparel also comprises a sleeve that is designed or configured to receive at least a portion of an arm of the person when the person wears the apparel. The protective apparel further comprises handwear that attaches to a distal portion of the sleeve. The handwear includes a hand portion that is designed or configured to cover at least a portion of the person's hand when the person wears the handwear. The handwear also includes material designed or configured to fit between two adjacent fingers of the person when the person wears the handwear. The handwear further includes multiple finger receptors, each finger receptor comprising flaccid material arranged to form a substantially tubular shape and include an aperture disposed at a distal end of the substantially tubular shape when the person wears the handwear.

In yet another aspect, the present invention relates to construction of apparel that improves protective apparel doffing. The apparel comprises a sleeve configured to receive a portion of an arm of a person. The method comprises attaching handwear to the sleeve. The handwear includes material designed or configured to fit between two adjacent fingers of the person when the person wears the handwear. The handwear also includes multiple finger receptors. Each finger receptor comprises an aperture and is designed or configured to receive a finger of the person through the aperture when the person wears the handwear. The handwear is designed or configured such that a portion of a glove worn over the handwear is restrained by the material designed or configured to fit between two adjacent fingers when the person doffs the glove.

These and other features of the present invention will be presented in more detail in the following detailed description of the invention and the associated figures.

Before committing to the Detailed Description, it may facilitate understanding to clarify certain words and phrases used in this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, be bound to or with, have, have a property of, or the like. Support and definitions for certain words and phrases are provided throughout this patent document, and those of ordinary skill in the art should understand that in many, if not most instances, such support applies to prior, as well as future uses of such words and phrases.

DESCRIPTION OF THE PREFERRED EMBODIMENTS

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known process steps and/or structures have not been described in detail in order to not unnecessarily obscure the present invention.

Systems and methods described herein include handwear that facilitates doffing of protective apparel and gloves worn with the protective apparel, such as disposable fingered latex gloves. The handwear is particularly advantageous to reduce the likelihood of undesirable agents located on outer surfaces of the sleeves and/or gloves from contacting the person during doffing.

Figure 1A:
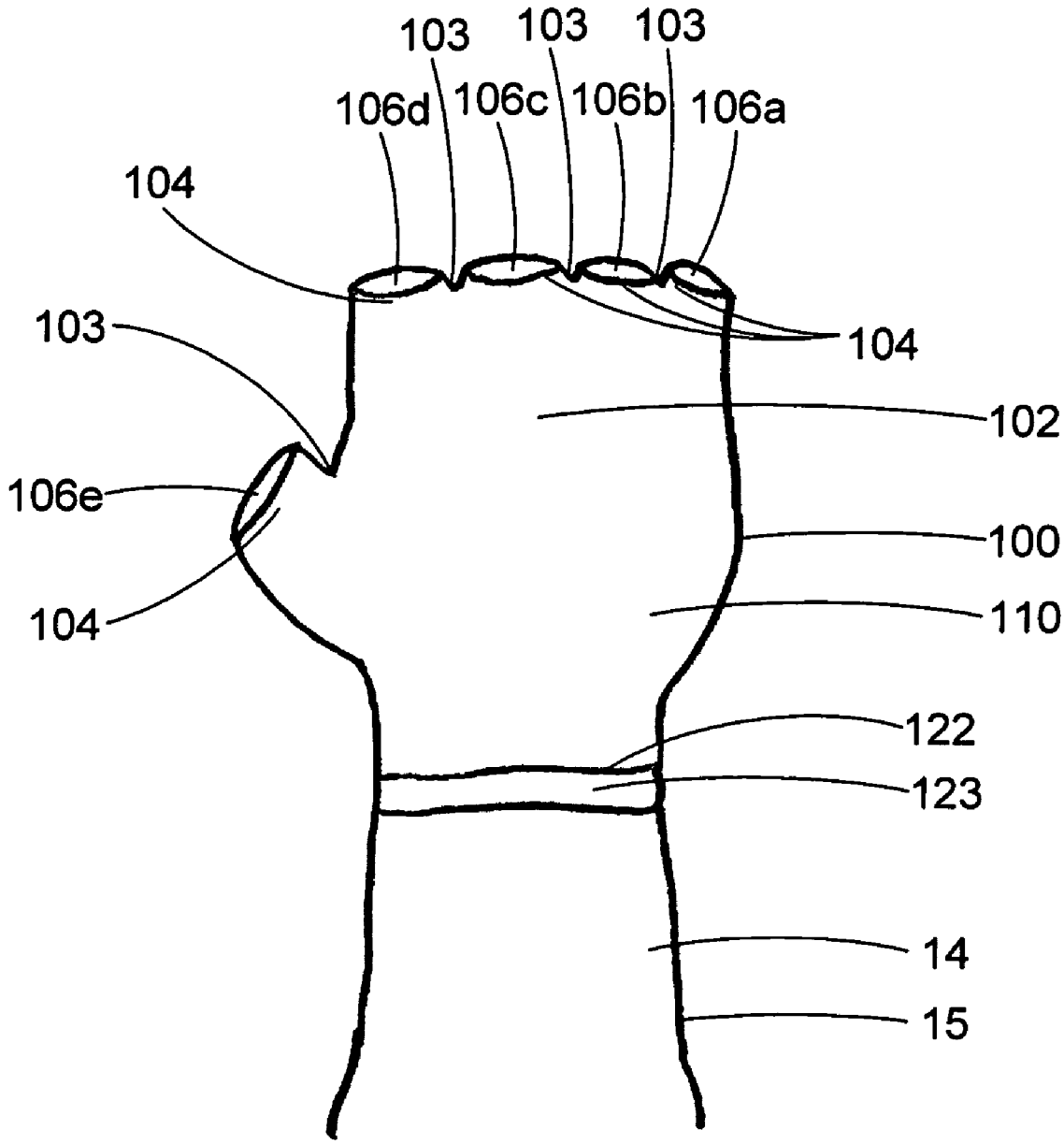
FIG. 1A illustrates an outer top perspective view of handwear in accordance with one embodiment of the present invention.

FIG. 1A illustrates an outer top perspective view of handwear 100 in accordance with one embodiment of the present invention. While the present invention will now be described as handwear to be worn by a person, those skilled in the art will recognize that the subsequent description may also illustrate methods and discrete actions for wearing and doffing handwear.

Handwear 100 comprises one or more relatively thin, flaccid or semi-flaccid materials 110 that form a hand portion 102 and multiple finger receptors 104. Material 110 provides the main physical barrier between space internal to handwear 100 and an environment external to handwear 100. Several materials suitable for use with handwear 100 are described below.

Handwear 100 comprises multiple finger receptors 104. Each finger receptor 104 includes an aperture 106. Each finger receptor 104 is designed or configured to receive a finger 115 (FIG. 1C) of a person through aperture 106 when the person wears handwear 100. As the term is used herein, 'finger' may refer to a finger or a thumb. As shown, handwear 100 comprises four finger apertures 106*a-d* and a thumb aperture 106*e* that are designed and positioned to receive four fingers and a thumb, respectively. Other numbers of finger receptors 104 may be used. Handwear 100 with two finger receptors 104 is suitable for some designs. The apertures 106 shown are sized such that person 11 can fit a single finger through each respective aperture. In another embodiment, each finger receptor 104 is sized to receive multiple fingers. For the embodiment shown in FIG. 1A, each finger receptor 104 and aperture 106 may be formed by cutting material 110 to a desired shape and sewing accordingly, e.g. between apertures 106.

It is understood that individual fingers for a given hand may vary in size and apertures 106 may be sized accordingly. Varying sizes of handwear 100 may be manufactured (e.g., small, medium and large). In one embodiment, material 110 comprises a stretchable material and each aperture 106 is undersized. In this case, material 110 around each aperture 106 conforms to the size and shape of an individual person's fingers. As will be described below, a slightly constricting fit provided by a stretchable material also aids in turning the handwear 100 inside-out upon doffing. A stretchable material 100 for handwear 100 allows one aperture 106 and aperture design for handwear 100 to fit many hand sizes, hand shapes and finger sizes. The design for handwear 100 may also be symmetrical such that left and right handwear pieces may be made from a common die cut to simplify manufacture.

In one embodiment, each finger receptor 104 is designed or configured such that a person's fingertip is not covered when the person wears handwear 100. This allows handwear 100 to function during doffing as described herein, but does not diminish tactile sensing for the person's fingertips or finger portions that extend beyond the handwear material. This is of value to surgeons and other medical practitioners, for example, who employ tactile sensing in practice. In a specific embodiment, each finger receptor does not extend past a first knuckle of a person when the person wears handwear 100.

Hand portion 102 is designed or configured to cover at least a portion of the person's hand when the person wears handwear 100. It is understood that handwear of the present invention may include less than full hand coverage. In the embodiment shown, hand portion 102 covers the entire palm, on both sides.

Hand portion 102 also includes material 103 designed or configured to fit between two adjacent fingers 115 (FIG. 1C) of the person when the person wears handwear 100. In one embodiment, material 103 comprises material 110 in hand portion 102 that is left after cutting holes for apertures 106, which typically rests close to a base between adjacent fingers for a person when the person wears handwear 100 and inserts their fingers in each aperture 106. Alternatively, handwear 100 may include material added to the handwear for resting between the person's fingers when the person wears handwear 100. During doffing of handwear 100 and a glove worn over handwear 100, material in handwear 100 between the person's fingers acts to restrain and limit the freedom of the outer glove, as will be explained in further detail below. In many instances, adjacent fingers of the glove are pulled within apertures 106 and material 103 restrains the glove where adjacent fingers of the glove connect.

Sleeve 14 is designed or configured to receive at least a portion of a person's arm when the person wears protective apparel that includes sleeve 14. Sleeve comprises a shroud material 15, which acts as a barrier layer between space internal to sleeve 14 and an environment external to sleeve 14. Handwear 100 attaches to a distal portion of sleeve 14 at seam 122. Distal in this case refers to portions of sleeve 14 that are towards a person's hands or distant from a point of attachment of sleeve 14. For example, sleeve 14 commonly attaches to a body portion of apparel at a shoulder seam (FIG. 2) and the distal portion of sleeve 14 represents the free end of sleeve 14, which is also where sleeve 14 may cover a wrist of a person.

Handwear 100 and sleeve 14 may attach using a number of techniques, such as sewing, taping, heat-sealing, adhesive and/or high energy (e.g., sonic) welding. Other attachment techniques may be used. The specific joining technique used may depend on the two materials being joined, cost, manufacturing ease, and the desired joint strength, as one skilled in the art will appreciate. Multiple joining techniques may also be implemented, such as sewing for seal strength and heat-sealing or peripheral taping to increase resistance to moisture penetration at the seam. The attachment may be permanent as in a sewing, or temporary via tape 130 (FIG. 1C) that is added by a user. In this latter case, the handwear and sleeve are provided separately. In one embodiment, handwear 100 comprises the same material as sleeve 14 and extends from the sleeve as a single piece of material.

An elastic cuff 123 may be disposed at or about seam 122 to facilitate fit about a wrist. The elastic cuff constricts the distal end of sleeve 14 and proximate portion of handwear 100 attached to sleeve 14 about the wrist. For handwear 100, 'distal' refers to features or locations that are closer to fingertips of the person, while 'proximate' refers to features or locations that are closer to shoulders of the person. Thus, proximate portions for handwear 100 may refer to portions of handwear 100 that are closer to the person's shoulders when the gloves are worn, such as near the wrist or near a point of attachment to sleeve 14. In one embodiment, the elastic cuff 123 is manufactured with a linear elastic material sewed circumferentially about the joint that constitutes the elastic cuff. Alternatively, handwear 100 and/or sleeve 14 may include a drawstring that allows a user to control circumferential fit and tension about the person's wrist.

In one embodiment, material 110 used in handwear 100 comprises a stretchable material that conforms to the shape of a person's hand. This facilitates fit of handwear 100 despite the wide variety of hand sizes and shapes. This also permits constriction of the hand and fingers to facilitate turning the handwear 100 inside-out during doffing and withdrawal of the hand. Stretchable materials such as cotton/lycra blends, spandex and nylon are suitable for many applications. In a specific embodiment, a cotton/lycra blend of 95/5 or 94/6 is suitable. Other stretchable materials are suitable for use with the present invention.

In another embodiment, handwear 100 comprises a liquid absorbent material. The liquid absorbent material absorbs fluids that penetrate the outer gloves 40 (FIG. 1C), such as blood that penetrates latex gloves in surgery. The liquid absorbent material also reduces moisture levels for the inside of handwear 100 and gloves 40. Latex gloves and their liquid and air impermeability commonly lead to hand perspiration. In this case, liquid absorbent handwear 100 may absorb some perspiration and diminish the amount of moisture perceived by person 11 below gloves 40. A cotton or cotton blend may provide suitable absorbance for many applications. Other liquid absorbent materials may be used. Alternatively, a layer of absorbent material may be attached to an inside surface of handwear 100.

Latex or rubber gloves worn over handwear 100 are known for having a lack of tear resistance after they have been punctured or cut. In another embodiment, handwear 100 comprises a tear resistant material. Woven materials used in handwear 100 such as cotton blends may thus provide a high tear resistance that complements a tear weakness in latex rubber gloves worn over handwear 100. Accidental puncture of latex gloves in surgery by a surgical tool is common (e.g., during handoff and transfer of a knife or other tool between practitioners). A stretched latex glove then tears easily after any small or localized puncture. A tear resistant handwear 100 worn under the latex glove increases protection for the surgeon until the outer glove is replaced. When the tear resistant material is liquid absorbent, the handwear 100 also reduces movement of surgical fluids internal to the latex glove after localized puncture. In this case, the handwear 100 and outer rubber glove thus cumulatively provide liquid impermeable, form fitting, and tear resistant protection.

In another embodiment, handwear 100 comprises a liquid and gaseous impervious material to prevent penetration of liquids and gases through handwear 100. A liquid impermeable material comprising polyethylene, latex or rubber is suitable in many applications.

Materials used in handwear 100 may also comprise the same or a different material as that used for shroud material 15 of sleeve 14, which simplifies manufacture. A material may also be selected to reduce cost of handwear 100 in applications where handwear 100 is disposable. While several exemplary materials have been provided above, the present invention is not limited to those described above and may include other materials used in the protective apparel industry.

Figure 1B:
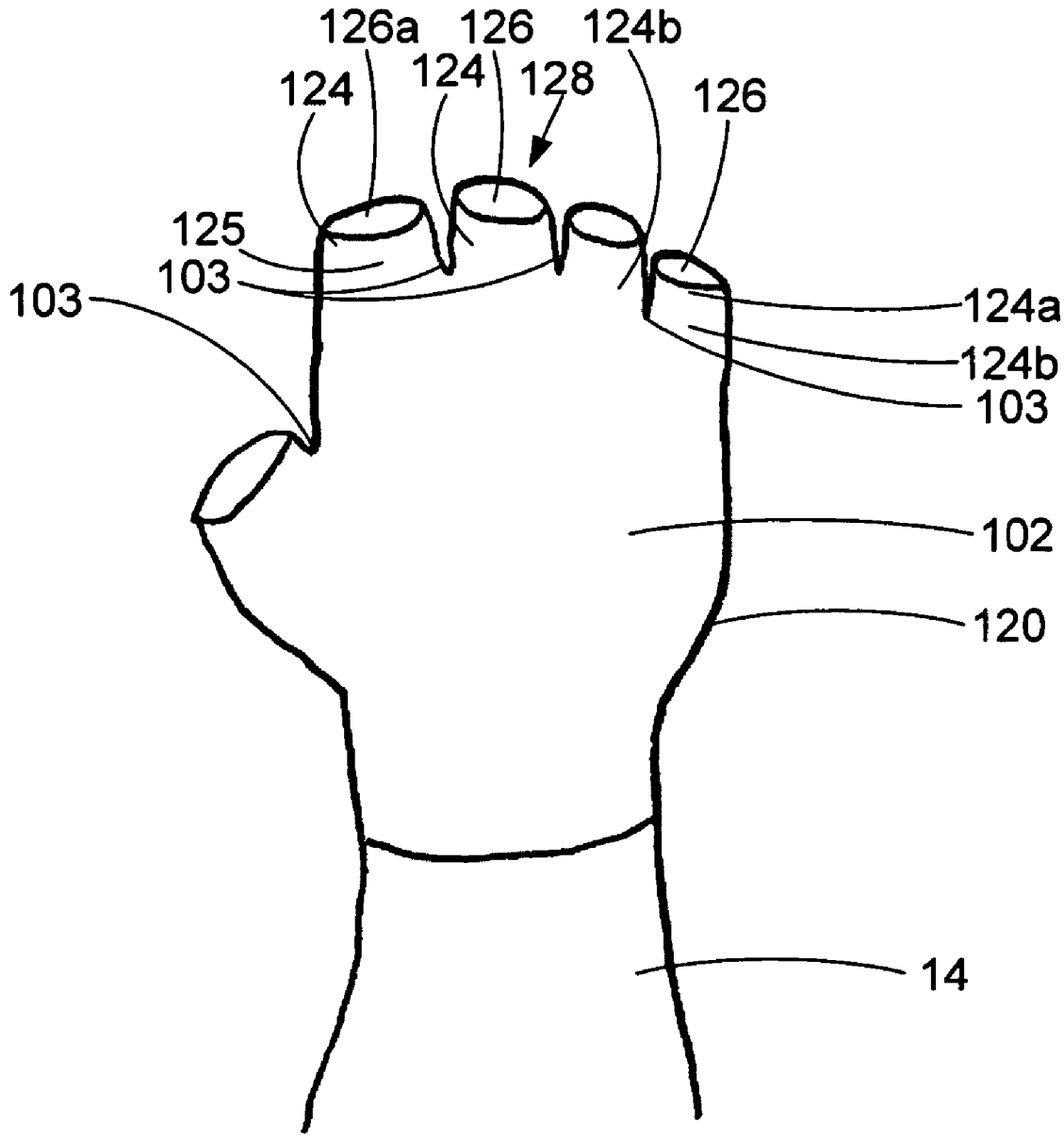
FIG. 1B illustrates an outer top perspective view of handwear in accordance with another embodiment of the present invention.
Figure 1C:
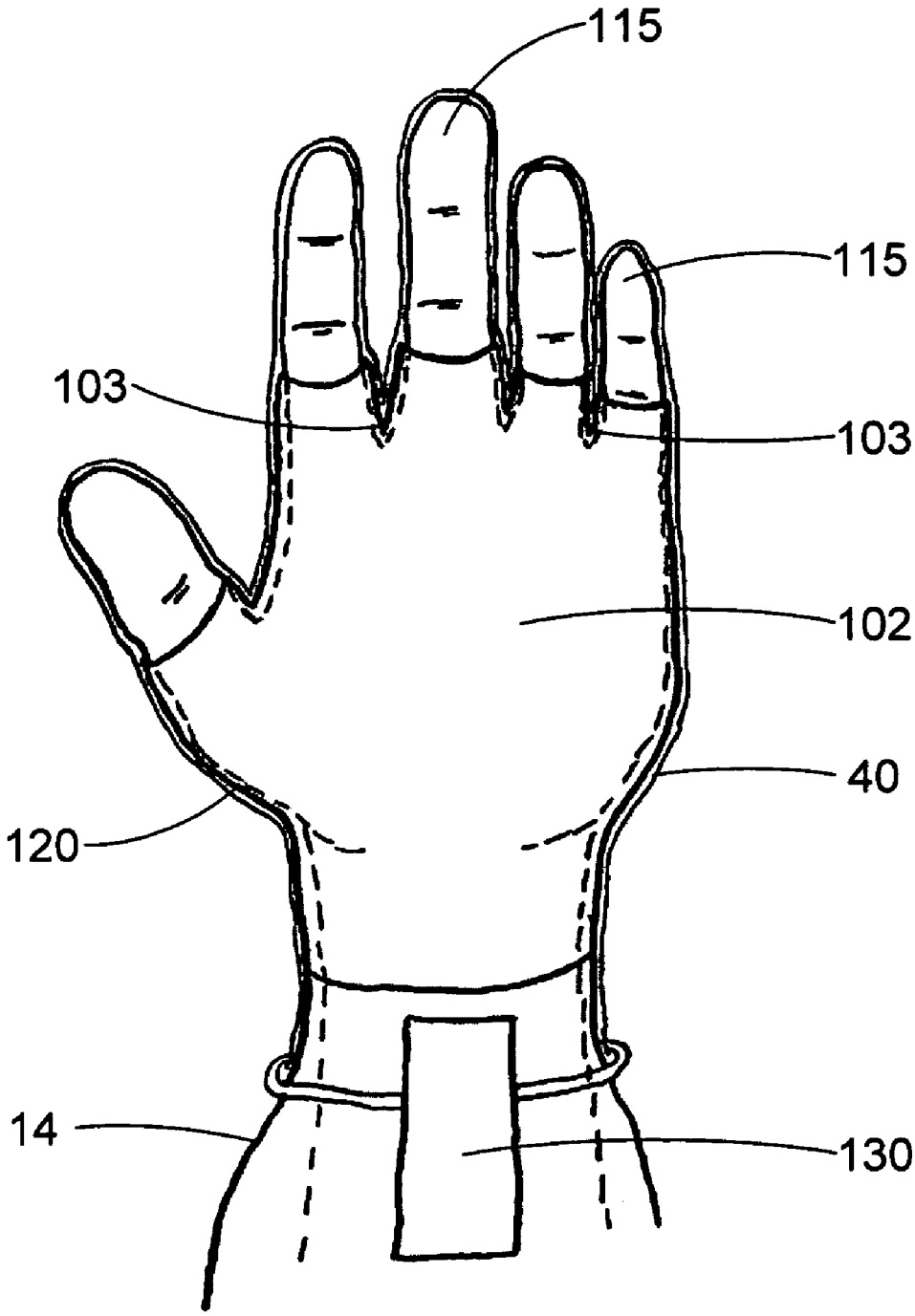
FIG. 1C illustrates the handwear of FIG. 1B worn under a transparent latex glove in accordance with one embodiment of the present invention.

FIG. 1B illustrates an outer top perspective view of handwear 100 in accordance with another embodiment of the present invention. FIG. 1C illustrates the handwear 100 of FIG. 1B worn by a person under a glove 40.

Referring initially to FIG. 1C, a person wears glove 40 over handwear 100 and dons glove 40 after donning handwear 100. As shown, glove 40 is a fingered glove that includes five glove fingers to receive all four fingers and a thumb for the person. Latex gloves are very popular, and are often disposed after a single use. Latex gloves also stretch and conform in shape to fit a person's hand. The stretch provides a constricted fit that facilitates pulling portions of glove 40 inside-out upon doffing. Some users prefer to tape 130 a latex glove to their sleeve to prevent movement or separation between the glove and sleeve during usage. As mentioned above, handwear 100 may not fully extend to the ends of the person's fingertips. In this case, the latex provides a high friction interface with the person's skin (or another latex glove worn underneath handwear 100) that additionally facilitates pulling portions of glove 40 inside-out upon doffing. Fingered gloves comprising one or more polymers, leather, knitted fabrics, or a non-woven material are also common, such as gardening gloves, work gloves, dish gloves, etc. The present invention is not limited by a type of glove 40 worn over handwear 100. The present invention also does not require glove 40 to include a full five fingered design and gloves with less than five fingers may also be suitable for use with handwear of the present invention. In one embodiment, glove 40 includes at least two fingers that are intended to border material 103 of handwear 100 that rests between the two respective fingers of the glove when the glove 40 and handwear 100 are both worn.

Referring to FIG. 1B, each finger receptor 124 comprises flaccid material 125 arranged to form a substantially tubular shape 128 and include an aperture 126 disposed at a distal end 124*a* of the substantially tubular shape 128. Each finger receptor 124 also comprises a proximate end 124*b* that attaches to or continues from material in hand portion 102. Aperture 126, which is disposed on the inside of the tubular shape 128, extends from proximate end 124*b* to distal end 124*a*. Material 125 in tubular shape 128 may be assembled from two separate flaccid material sheets to achieve the tubular shape 128, or a single piece and sewed to achieve the substantially tubular shape 128. Other forms of constructing the tubular shapes 128 are known to those of skill in the art. For example, the handwear 100 may be cut from an existing glove design of a desired material to simplify manufacture.

A distance between the distal end 124*a* and proximate end 124*b* defines a length for the tubular shape 128. In one embodiment, the distal end 124*a* of each finger receptor 124 is configured to not extend beyond the first knuckle of a finger it receives. This allows a person's fingertips to not be covered by material 110 when the person wears handwear 100. Similar to the embodiment described above for FIG. 1A, this avoids diminishing tactile sensing for the person's fingertips or finger portions that extend beyond distal end 124*a*. In another specific embodiment, each finger receptor 124 measures less than half an inch from the distal end 124*a* to the proximate end 124*b*. Other lengths and distances may be used. Handwear 100 may also be configured and cut to a number of sizes, such as a small, medium and large, in which handwear 100 and tubular finger receptors 124 (length and diameter for aperture 126) are dimensioned to service a range of hand sizes.

Material used in finger receptors 124 may comprise the same material 110 as that used in hand portion 102. In one embodiment, portions of handwear 100 and each finger receptor 124 include contiguous material with hand portion 102 to ease manufacture.

For the embodiment shown in FIG. 1B, material 103 designed or configured to fit between two adjacent fingers of the person may comprise material 110 that is continuous with material used in hand portion 102 and rests between adjacent fingers and/or material used in the tubular finger receptors 124 during usage of handwear 100 (FIG. 1C).

In practice, a person typically dons handwear 100 when they don sleeve 14 (if the two are pre-attached). Alternatively, the person may attach handwear 100 to sleeve 14 after donning each component separately if the two are not provided together, e.g., using tape. Outer glove 40 is then donned and worn over handwear 100 (and may be taped to the sleeve). Handwear 100 includes material designed or configured to fit between two adjacent fingers of the person and glove when the person wears handwear 100. Thus, if the glove has only two fingers in which all the person's fingers enter, handwear 100 includes material that fits between these combined glove fingers when the person wears the apparel. For a five fingered glove, handwear 100 may include material designed or configured to fit between all five fingers (including the thumb) in four locations, e.g., handwear 100 shown in FIGS. 1A-1D.

When ready to doff the handwear 100 and outer glove, the person withdraws their hand from handwear 100 and from glove 40. In one embodiment, the person pulls one or more portions of handwear 100 inside-out along with the outer glove and sleeve 14. The handwear then restrains a portion of the glove, prevents the glove from following the person's hand, and may contain one or more portions of the glove.

Figure 1D:
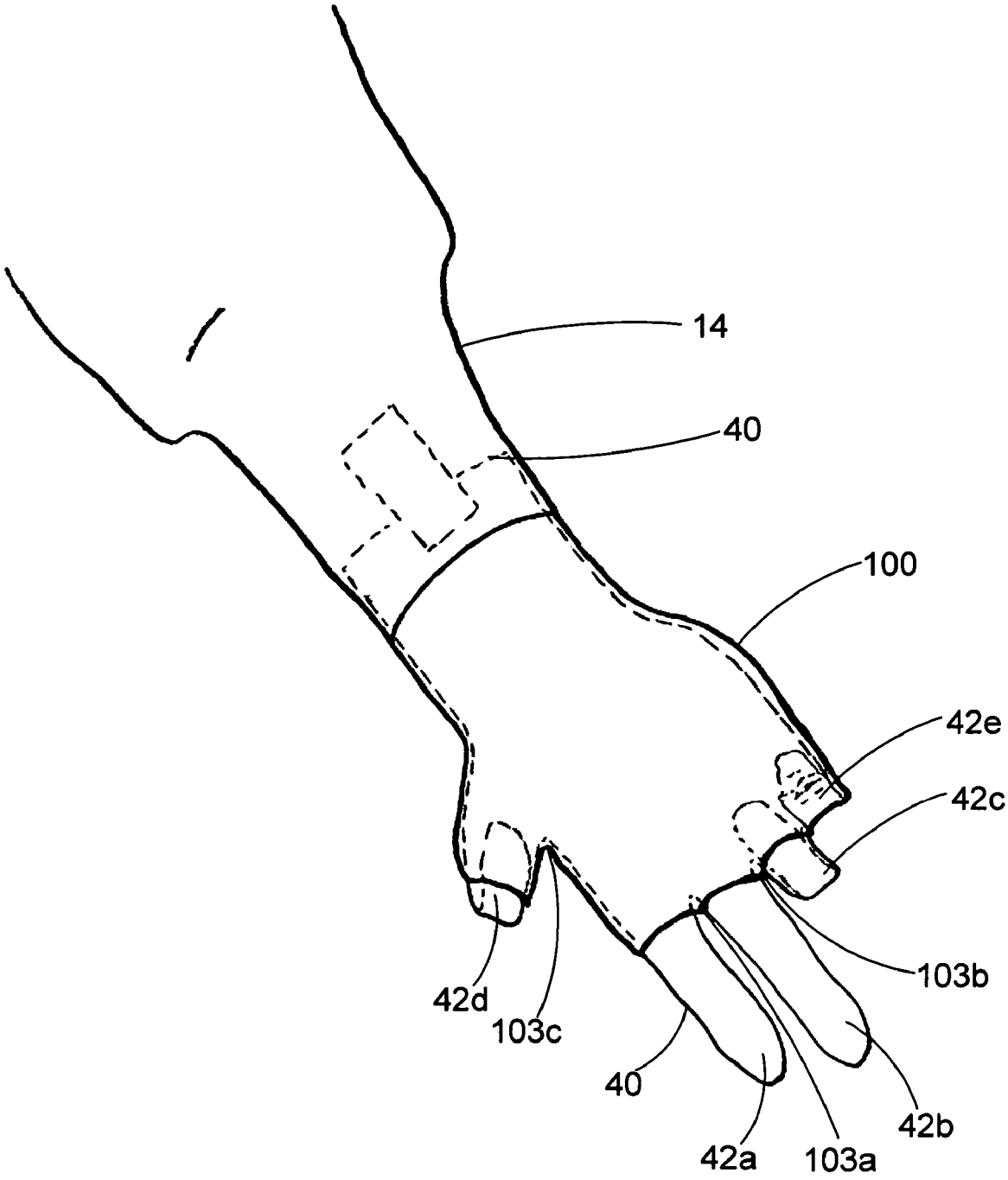
FIG. 1D illustrates an exemplary instance of a sleeve, handwear of FIG. 1A, and a glove pulled inside-out in accordance with one embodiment of the present invention.

FIG. 1D illustrates an exemplary instance of sleeve 14, handwear 100 of FIG. 1A and glove 40 pulled inside-out in accordance with one embodiment of the present invention. In this instance, all of handwear 100 has been turned inside-out; glove fingers 42*a* and 42*b* have been fully pulled inside-out and through finger apertures 106; glove fingers 42*c* and 42*d* have been partially pulled inside-out and through finger apertures 106; and glove finger 42*e* has not escaped the inside-out handwear 100 or traveled through its respective aperture 106. In this case, handwear material 103*a* restrains glove material between glove fingers 42*a* and 42*b*, handwear material 103*b* restrains glove material between glove fingers 42*b* and 42*c* and handwear material 103*c* restrains glove material between glove fingers 42*a* and 42*d*. Cumulatively, the three restraining instances between handwear 100 and glove 40 maintain glove 40 inside the inside-out handwear 100, thereby preventing the inside-out glove 40 from escaping the inside-out handwear 100 and allowing the person to separate their hand from glove 40 without touching a previously outside surface of glove 40. In other instances, other combinations of glove fingers 40 may or may not travel into apertures 106. If all five glove 40 fingers do not travel through apertures 106, then the entire glove 40 is contained within handwear 100. Further description of doffing handwear 100 is described with respect to FIG. 3A.

In one embodiment, handwear 100 is pulled through sleeve 14 along with any attached portions of the apparel. This turns handwear 100—and parts of sleeve 14 attached thereto—inside-out. In one embodiment, all portions of protective apparel 10 distal to the shoulder seam that are continuously attached to handwear 100 are either a) inside-out after doffing, and/or b) contained within the inside-out handwear 100 and inside-out sleeve 14. As a result, undesirable agents—that were initially on outside surfaces of the apparel (including the handwear, glove and sleeve) are now inside the inside-out handwear and inside-out sleeve. This advantageously locates and contains undesirable agents—that were initially on outer surfaces of apparel 10—inside the inside-out handwear 100 and sleeve 14. Since inner surfaces of apparel 10 were not continuously exposed to undesirable agents, conversion of handwear 100 and sleeve 14 to an inside-out state allows person 11 to manipulate and handle handwear 100 and sleeve 14 (after doffing) using the unexposed inner surfaces of handwear 100 and sleeve 14, thereby reducing cross contamination risk.

Figure 2:
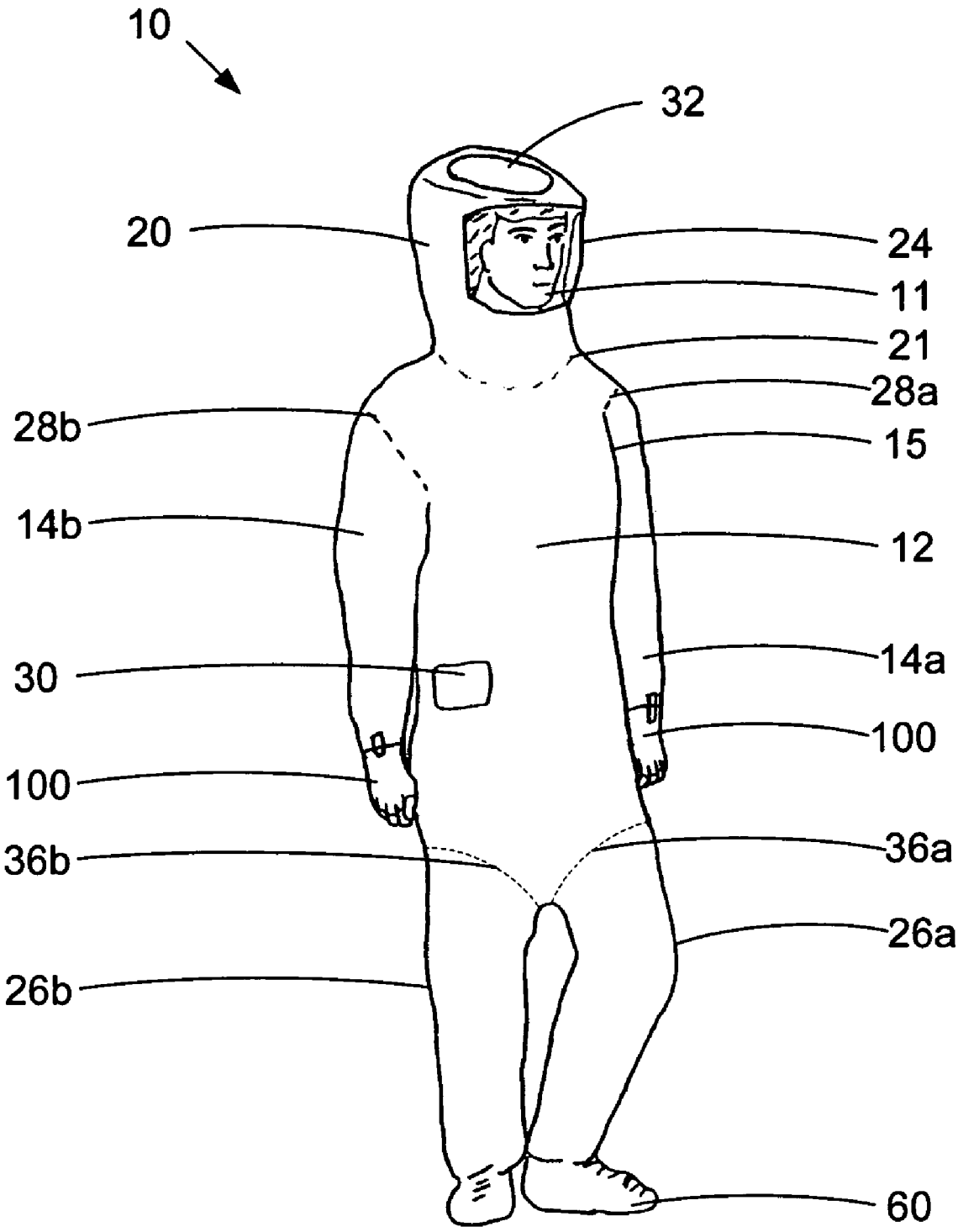
FIG. 2 illustrates a front elevation view of protective apparel in accordance with one embodiment of the present invention.

FIG. 2 illustrates an outer front elevation view of protective apparel 10 in accordance with one embodiment of the present invention. While the present invention will now be described as protective apparel for use by a person, those skilled in the art will recognize that the subsequent description may also illustrate methods and discrete actions for using protective apparel.

Apparel 10 generally refers to a garment assembly for use by a person 11. Apparel 10 comprises multiple components that are attached to form the garment assembly. As shown in FIG. 2, apparel 10 comprises body portion 12, sleeves 14, hood 20, pant legs 26, boots 60, handwear 100 and separate outer gloves 40. Apparel 10 may be used with a headgear assembly (not shown) that rests within hood 20 and maintains the position of hood 20. In one embodiment, apparel 10 also comprises a transition portal that allows person 11 to doff apparel 10 without contact between person 11 and an outside surface of apparel 10. Further description of doffing and transition portals used with protective apparel is described in commonly owned patent application Ser. No. 10/888,442 and entitled "Protective Apparel with Improved Doffing", which is incorporated by reference herein for all purposes. In one embodiment, apparel 10 resembles a garment assembly or full-body suit that covers the entire body of person 12. In this case, apparel 10 creates an environment internal to apparel 10 and separates the internal environment from an environment external to apparel 10. In another embodiment, apparel 10 resembles a gown with an open bottom and no pant legs. Filters 30 and 32 regulate air and particulate passage through specific portions of apparel 10, while a blower or fan neighbors one of the filters 30 and 32 to move fresh air into apparel 10 for breathing and/or cooling. A zipper may be included in apparel 10 to facilitate donning and/or doffing.

Shroud material 15 provides the main physical barrier between the environment internal to apparel 10 and the environment external to apparel 10. Shroud material 15 comprises a relatively thin, flaccid or semi-flaccid sheet. Shroud material 15 is included in most components of apparel 10, such as body portion 12, sleeves 14, pant legs 26, boots 60, and hood 20. In one embodiment, apparel 10 is designed to loosely fit about person 11. In this case, shroud material 15 loosely fits about person 11.

Body portion 12 includes shroud material 15 and covers at least a portion of the person's 11 torso. For the embodiment shown in FIG. 1, body portion 12 extends perimetrically about the person's torso and downward from the person's neck and shoulders to below the person's groin, thereby shrouding the full torso. Body portion 12 may extend downward from the shoulders to the waist of person 11, or may extend lower than the waist to the knees, the ankles, a point between the thighs and knees, or a point between the knees and ankles. In one embodiment, body portion 12 is constructed with no seams in the front hemisphere.

Hood 20 substantially covers the wearer's head and neck; and comprises hood shroud material 15 and a viewing window 24. A lower portion of the hood shroud material 15 attaches to an upper portion of body portion 12 at seam 21. Viewing window 24 is arranged to be in front of the person's face when person 11 wears apparel 10. Viewing window 24 allows person 11 to see out of hood 20. Viewing window 24 comprises a thin, lightweight and transparent barrier, such as a suitable plastic. In one embodiment, shroud material 15 included in hood 20 attaches to viewing window 24 about the perimeter of viewing window 24. Shroud material of hood 20 and viewing window 24 may be attached by taping or with a suitable adhesive, for example. Viewing window 24 may curve about the person's face to increase visibility out of hood 20.

Left and right sleeves 14*a* and 14*b* include shroud material 15 and attach to a shoulder portion of body portion 12 at seams 28*a* and 28*b*, respectively. In another embodiment, the entire front portion of apparel 10 is constructed from a single piece of material and seams 28 do not exist between body portion 12 and sleeves 14. Sleeve 14*a* receives a left arm of person 11, while left sleeve 14*b* receives a right arm of person 11. While sleeves 14 are shown as extending up to the shoulder of person 11, it is understood that different designs and assemblies of apparel 10 will vary the extent of arm coverage provided by each sleeve 14. At the least, each sleeve 14 receives and covers a portion of an arm, such as parts of the forearm and/or wrist, depending on the style of garment and desired amount of coverage in design. Seams 28 attach and potentially seal the separate pieces of shroud material 15 included in body portion 12 and sleeves 14; and may include stitching, tape, and/or a heat or ultrasonic seal, depending on the materials being attached and desired degree of protection.

Handwear 100 is disposed at the distal end of each sleeve 14. In one embodiment, each handwear 100 integrally attaches to the distal end of each sleeve 14. In another embodiment, apparel 10 and handwear 100 are provided separately and the user may attach them with tape, for example. Attaching handwear 100 to sleeves 14 (as provided with apparel 10 or subsequently by person 11 using tape 25) allows person 11 to remove apparel 10 as a single unit as opposed to disparate units, as described in further detail below with respect to FIG. 3A.

Person 11 wears outer gloves 40 over handwear 100 (FIG. 1C). The gloves 40 may also be pulled up to cover a distal portion of sleeve 14. To do so, person 11 typically dons gloves 40 after donning handwear 100. Gloves 40 may comprise a stretchable material that conforms to the shape of the person's hand. Gloves 40 may also comprise a gaseous and liquid impermeable material. Materials such as latex, polyethylene, rubber, and elastic synthetic are suitable for gloves 40 and the present invention is not limited by the materials used in or type and style of gloves 40.

Left and right pant legs 26*a* and 26*b* include shroud material 15 and attach to a lower portion of body portion 12 at seams 36*a* and 36*b*, respectively. In another embodiment, the entire front portion of apparel 10 is made from a single piece of material and seams 36 do not exist between body portion 12 and pants legs 26. As shown in FIG. 2, pant legs 26 extend from body portion 12 from the midpoint of the person's thighs. In this case, each pant leg 26 only receives a portion of each leg from the thigh to the foot. As mentioned above, body portion 12 may extend down to a different part of person 11, such as the waist or the knees, which will determine the length of each pant leg 26. Boots 60 are integrally attached to the distal ends of each pant leg 26. Boots 60 cover the shoes worn by person 11.

A filter 30 is sewn or otherwise suitably attached to shroud material 15. Filter 30 spans a hole in shroud material 15, forms an air permeable wall in place of the hole, and intercepts air before flow into apparel 10. Inlet filter 30 may selectively regulate the passage of air and any particulates in the air, such as any undesirable agents, into apparel 10. In one embodiment, inlet filter 30 comprises a sub-micron filter (such as a HEPA filter) having an effective porosity that substantially prevents particles of a particular size from passing through. Typically, the inlet filter 30 material and type is varied according to the undesirable agent(s) to be selectively blocked. The material used in filters 30 and 32 is commercially available from a wide variety of vendors known to those skilled in the art. Inlet filter 30 may provide a pressure drop across its thickness, which is overcome by a blower or fan.

A blower (not shown) moves air from the environment external to apparel 10 into the environment internal to apparel 10. The blower may be on the inside of shroud material 15 or on the outside. Air provided by the blower ventilates the environment internal to apparel 10, cools the person wearing apparel 10, and provides fresh air for breathing. The blower may comprise a fan and motor suitably sized to provide a desired flow rate of air into and/or within apparel 10. Blower may comprise any conventional fan mechanism, such as those including a rotating fan assembly and powered by a rechargeable battery. Such devices are commercially available from a wide variety of vendors and known to those of skill in the art.

Air filter 32 exhausts air from an environment internal to apparel 10 to an environment external to apparel 10. Outlet filters 32 may also be included in other portions of apparel 10 and hood 20, such as the backside of hood 20 and the neck below viewing window 24. Outlet filters 32 may also be disposed at the top of the person's shoulders, in sleeves 14 and/or in pant legs 26. Filters 32 may be arranged to specifically create low pressure zones and draw airflow to a certain area within apparel 10 proximate to a portion of person 11. Multiple filters may also be sized to achieve a desired airflow distribution, e.g., for breathing.

While the present invention has primarily referred to inlet filters that prevent undesirable agents from passing into apparel 10, it is understood that applications such as clean rooms and surgical rooms require apparel and filters that prevent escape of the undesirable agents. In this case, outlet filters 32 selectively transmit air and contaminants moving from the environment internal to the apparel to a clean environment outside the apparel, such as filtering out bacteria and microorganisms carried by person 11 to maintain a sterile zone for surgical applications.

Shroud material 15 typically comprises one or more relatively thin, flaccid sheets. Shroud material 15 forms a large portion of apparel 10 and is included in multiple parts of apparel 10 such as body portion 12, sleeves 14, pant legs 26, boots 60, and hood 20. The number of pieces of material 15 will depend on how apparel 10 is manufactured and assembled, as one skilled in the art will appreciate, and the present invention is not limited to any particular style, assembly or design of apparel 10. Usually, a single type of material is employed for shroud material 15, however, it is contemplated that multiple types of shroud material 15 may be used (e.g., one shroud material 15 for body portion 12 and another shroud material 15 for sleeves 14 and/or hood 20). In one embodiment, shroud material 15 comprises a breathable and selectively filtering material that prevents transmission of a targeted undesirable agent through shroud material 15. In another embodiment, shroud material 15 comprises a substantially air and/or liquid impermeable material, such as a suitable plastic or non-woven fabric. Shroud material 15 may also comprise a breathable or breathable and splash resistant material, such as a non-woven fabric. Breathable portions of material 15 may also operate as a filter for outlet of air from the environment internal to apparel 10 to the environment external to apparel 10. In addition, different materials may be added or combined to shroud material 15 to increase comfort, protection, strength, appearance or another property of apparel 10. For example, plastic materials may be combined with non-woven materials to increase protection. A commercially available material such as one of the Tyvek series as provided by DuPont of Wilmington, Del., is suitable for use in shroud material 15. A non-woven such as one of the Spunbond series as provided by Kimberly-Clark Health Care of Roswell, Ga. may also be suitable. In a specific embodiment, one of ProVent 1000, 3000, 7000, 7500 or 10,000 as provided by Kappler of Guntersville, Ala., is suitable for use. Shroud material 15 may also comprise a material based on polymers and copolymers of vinyl chloride, vinylidene chloride, ethylene, acrylic acids and esters, methacrylic acids and esters, propylene amines such as polyamides and other polymerizable monomers, cotton and silk, compressed nylon, polyester, and/or spandex (which may be used to increase user comfort and fit).

In general, seams of the present invention (such as seam 21 between hood 20 and body portion 12) may include sewing, taping, heat sealing, an adhesive and/or solvent or sonic welding. The specific joining technique used will depend on the two materials being joined, manufacturing ease, cost, and a desired level of protection, as one skilled in the art will appreciate. Multiple joining techniques may also be implemented, such as sewing for seal strength and heat-sealing for seal integrity.

In one embodiment, apparel 10 is airtight except for gaseous communication via inlet filters 30 and outlet filters 32. Apparel 10 then provides an isolated or encapsulated system in which air from the environment external to apparel 10 is transmitted into an environment internal to apparel 10 through inlet filters 30 and out through filters 32. Correspondingly, person 11 is isolated from the ambient environment except through controlled filtering.

In one embodiment, apparel 10 is disposable. In some cases, all portions of apparel 10 are disposable except the blower. Disposable apparel benefits health care environments and hospitals for example since practitioners may dispose of contaminated materials readily. In another embodiment, apparel 10 is reusable. In this case, apparel 10 may be cleansed of known undesirable agents such as biological agents with a bath in chlorine, for example.

Figure 3A:
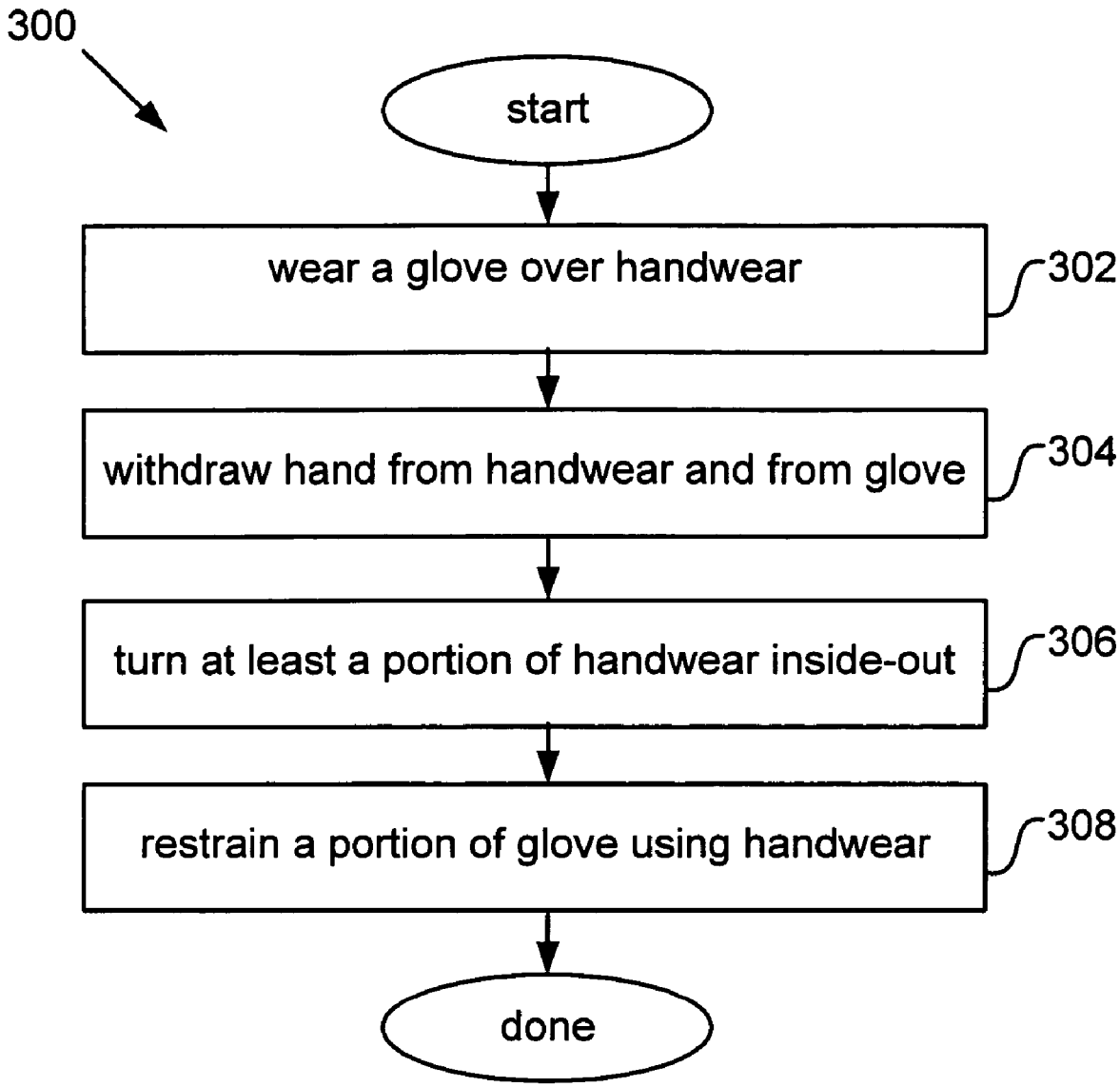
FIG. 3A illustrates a process flow for doffing apparel in accordance with one embodiment of the invention.

FIG. 3A illustrates a process flow 300 for doffing protective apparel in accordance with one embodiment of the invention. As the term is used herein, doffing refers to divesting, undressing or removing clothing and clothing portions. The present invention employs handwear to assist doffing and to reduce the risk of cross-contamination during and after doffing. The handwear attaches to a sleeve at a distal end of the sleeve, e.g. near the wrist. While the present invention will now be described as a methods and actions for using and doffing protective apparel, those skilled in the art will recognize that the subsequent description may also illustrate protective apparel that permits the described method and actions.

Process flow 300 begins by wearing a glove over handwear attached to a distal portion of a sleeve (302). The sleeve covers at least a portion of an arm of a person. The handwear includes material designed or configured to fit between two adjacent fingers of the person when the person wears the handwear, a few examples of which are illustrated and described with respect to FIGS. 1A-1D. In one embodiment, the handwear and sleeve are worn with protective apparel. One instance of full coverage protective apparel is described above with respect to FIG. 2. In this case, handwear attaches to the ends of sleeves 14 at integrated seams.

Wearing implies that handwear 100 and sleeve 14 were donned at an earlier time. For donning, the user extends his arms through sleeves 14 into handwear 100 and adjusts for fit as desired. Gloves, such as widely available latex or rubber gloves, are then donned over the handwear. Plastic tape may be added to secure the open end of the gloves to sleeve material about the person's wrist or forearm. In this case, upon removal of the gloves and sleeves, the open end of a glove and a sleeve move together via the tape attachment.

The person may use the apparel and handwear in an environment that potentially offers an undesirable agent. Undesirable agents may include gaseous or liquid agents, biological and/or chemical molecules, microorganisms, airborne contaminants that are in a gaseous, liquid or solid state, and other substances that the person wants minimal or no exposure to. The apparel may also be designed to address the dual function of minimizing transfer of undesirable agents from the person wearing the apparel to environments and persons outside the apparel. In this case, the apparel may include exhaust filters that filter air passing out from the apparel and is thus well suited for use by nurses and other practitioners in an operating room or surgical environment to prevent passage of undesirable agents from the practitioner to a surgery patient. Apparel 10 is also well suited for use in low contamination rooms and other places such as "clean rooms". The latter is common in the semiconductor industry where contamination contributions by occupants are to be minimized.

When ready to doff, the wearer withdraws their hand from the handwear and their hand from the glove (304). The person may also pull portions of the sleeve inside-out, or even the entire sleeve, before withdrawing their hand from the handwear. In some cases, if the person braces sleeve or handwear material about the wrist, then hand withdrawal from the handwear may occur within the sleeve. Alternatively, if the person does not brace material about the wrist, and/or if there is an elastic cuff at the wrist, the person may proceed to pull the handwear within the sleeve and turn the sleeve inside-out before drawing their hand from the handwear and from the glove.

If the handwear is included with full body apparel, the person also doffs the apparel, which may occur before and/or after doffing the handwear according to the apparel construction. For full body apparel, the person may first escape from the main body of the apparel, such as the body portion and pants, and then doff the handwear. Alternatively, the person may doff a portion of the apparel such as the head through a back entrance/exit zipper, doff the handwear, and then finish removal of the apparel. One advantage of the present invention is that doffing may occur without external help from another person, if desired.

In one embodiment, at least a portion of the handwear turns inside-out as the person doffs the handwear (306). This typically happens as the hand pulls from the handwear. The handwear turns inside-out as a result of forces that prevent clean withdrawal, such as forces between the person's hand and the handwear and/or between the person's hand and outer glove. For example, if the handwear fits snugly over the hand, tension in the stretchable material or handwear fit resists relative motion between the person's hand and the handwear. A similar snug fit and resistance may occur with a tight fitting outer glove such as a fingered latex glove that comprises a stretchable material which conforms to the shape of the person's hand and fingers. Since the handwear is disposed between the glove and person's hand, snug fit and resistance of the outer glove may also doubly transfer fit and movement-resistive forces onto the handwear. The locations of constriction between glove and hand will depend on design of the glove and shape of the person's hand. Glove materials such as latex may also increase friction with the skin or handwear for portions of the hand that are not covered by the handwear. When the person withdraws their hand from the handwear, the resistance forces cause at least a portion of the handwear to turn inside-out. In addition to snug fit and friction resistance, there may be other causes and forces that turn the handwear inside-out as the person withdraws their hand and doffs the handwear. For example, the handwear and glove may interface with each other, get caught, tangle, or otherwise resist clean withdrawal of the person's hand from the handwear and/or glove. The person may also assume a fist, curl fingers or assume another hand position that prevents their hand from cleanly escaping the handwear and/or outer glove.

Regardless of where the resistance develops, a portion of the handwear turns inside-out. The portions that turn inside-out will depend on a) the handwear construction, b) which parts of the handwear are pulled or affected by resistive forces that oppose withdrawal, and c) which parts of the handwear are able to move inside-out as the person withdraws their hand. For the handwear of FIGS. 1A and 1B, the material designed or configured to fit between two adjacent fingers of the person when the person wears the handwear may turn inside-out. As will be described below, this is useful in restraining the outer glove. In addition, some of the hand portion 102 may turn inside-out as the person withdraws their hand from the handwear. For the handwear of FIG. 1B, one or more individual tubular finger sleeves may also turn inside-out, partially or fully.

Process flow 300 continues with restraining a portion of the outer glove using the handwear (308). As the outer glove fingers turn inside-out and follow the person's fingers while they are withdrawn from the handwear (e.g., the outer glove includes a stretchable material that constricts about the person's fingers), material in the handwear of the present invention prevents the glove from fully following the hand. For example, material in the handwear that is designed or configured to fit between two adjacent fingers of the person when the person wears the handwear restrains material in the glove between the corresponding two adjacent glove fingers when the person pulls the glove inside-out. The handwear material between the two adjacent fingers then prevents this portion of the glove from escaping the handwear. One such blockage is suitable to prevent escape of a glove from the handwear. For a five fingered glove (including thumb), there are four such places this may occur. For the handwear 100 shown in FIGS. 1A and 1B, all four material locations 103 may individually restrain glove material that they neighbor.

Figure 3B:
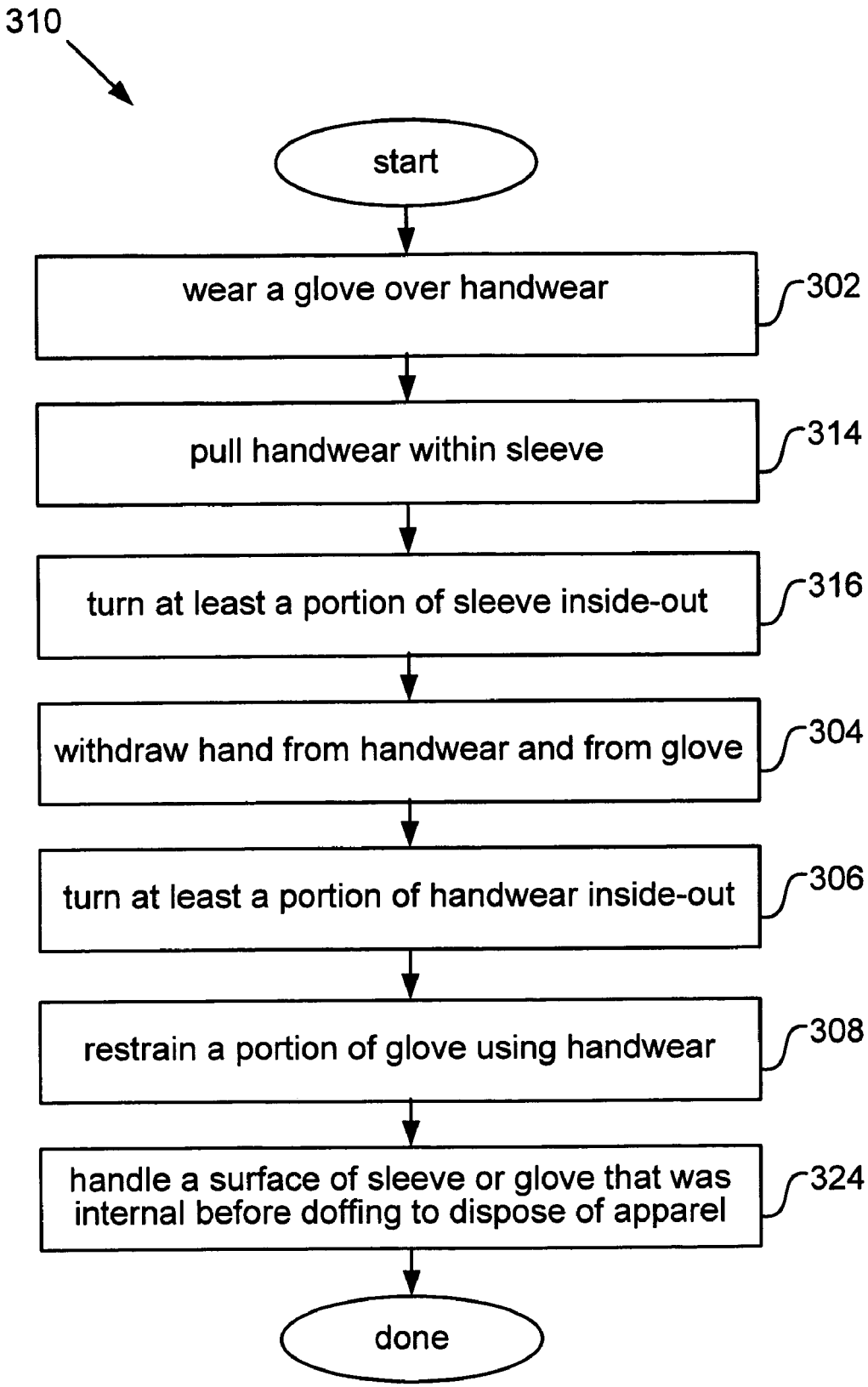
FIG. 3B illustrates a process flow for inside-out doffing of apparel in accordance with one embodiment of the invention.

FIG. 3B illustrates a process flow 310 for doffing protective apparel in accordance with another embodiment of the invention. In this case, process flow 310 expands process flow 300 of FIG. 3A to include one or more instances of turning apparel inside-out to facilitate doffing and disposal of the apparel. Process flow 310 begins with wearing a glove over handwear that attaches to a sleeve (302 of process flow 300).

The person then pulls the handwear within the sleeve (314). This may occur, for example, if the person does not brace material about the wrist when they pull to withdraw their hand from the handwear, and/or if there is an elastic cuff at the wrist that prevents clean withdrawal of the hand from the handwear. In one embodiment, an elastic cuff is disposed at a seam that connects the sleeve and handwear. The elastic cuff constricts the distal portion of the sleeve and portion of the handwear attached to the sleeve about the person's wrist, which is typically smaller in diameter than the base of the hand. When the person withdraws their hand, the elastic cuff resists expansion to the larger hand diameter and thus opposes clean removal of the hand from the handwear—thus causing the distal portions of the sleeve to move inwards on themselves. The elastic cuff may additionally constrict material about the person's wrist, leading to circumferential tension between the elastic cuff and wrist that causes the sleeve around the cuff to be pulled and turned inside-out. Alternatively, if a latex glove is adhered, e.g. taped, to an outer surface of the sleeve before doffing, the tape may also pull and turn a sleeve inside-out. During doffing, tight fit for a glove or handwear may cause the glove—and attached sleeve via the tape—to both be pulled inside-out.

Distal portions of the sleeve then turn in on themselves and at least a portion of the sleeve turns inside-out (316). The sleeve may eventually completely turn inside-out if the person fully pulls their hand out of the sleeve. For example, the person may fully pull the sleeve and their hand out of a shoulder seam.

At this point, the wearer may withdraw their hand from the handwear (304 of process flow 300) and their hand from the glove. To overcome resistive forces in the handwear, the person may brace the inside-out sleeve and attached handwear manually. Alternatively, the sleeve may be pulled taught with the shoulder seem and apparel acting as a movement limiting brace. The person may then turn at least a portion of the handwear inside-out as the person withdraws their hand from the handwear (306 of process flow 300). Process flow 310 continues with restraining a portion of the outer glove using the handwear (308 of process flow 300).

Once doffing from the sleeve, handwear and apparel is complete, disposal of the apparel may occur. This includes handling surfaces of the handwear and sleeve that were internal before doffing (324). Doffing handwear according to process flow 310 thus converts outer surfaces the outer glove and sleeve, which were potentially exposed to any undesirable agents during usage, inside-out. Outer potentially contaminated surfaces then become inner surfaces during and after doffing that are less exposed for cross-contamination with the person. The present invention thus allows the person to doff a sleeve and outer glove without physical contact between the person and a previously outside surface of glove or sleeve. Physical contact between the person and an outside surface of sleeve or glove refers to contact between an outside surface of the sleeve or glove and the skin of the person or clothes worn by the person, such as a shirt sleeve. An outside surface of the sleeve or glove refers to any surface of the sleeve or glove that is exterior while wearing the protection apparel. In one sense, both inner and outer surfaces of handwear of the present invention may not be considered outside surfaces since they are both contained within the outer glove during usage. In other words, the outer glove forms a layer that protects the inner handwear from exposure to the ambient environment and potential contamination.

Thus, if the person pulls their hand out without initially bracing a distal portion of their sleeve, the person may eventually pull all portions of their sleeve and outer glove inside-out with handwear and methods of the present invention. As mentioned before, inner surfaces of the glove and sleeve have likely not been exposed to contaminants or undesirable agents in the outer environment during usage. After doffing according to the present invention, internal surfaces that were not continuously exposed to undesirable agents now become the external surfaces for the apparel, glove and sleeve. Subsequently, the person may use these previously internal surfaces for handling and disposal of the apparel. In addition, previously external surfaces of the glove and sleeve that were potentially exposed to undesirable agents now become internal surfaces of the apparel, glove and sleeve. These surfaces are hidden from the person and present less cross-contamination risk than if they were exposed in their state before inside-out doffing.

Figure 3C:
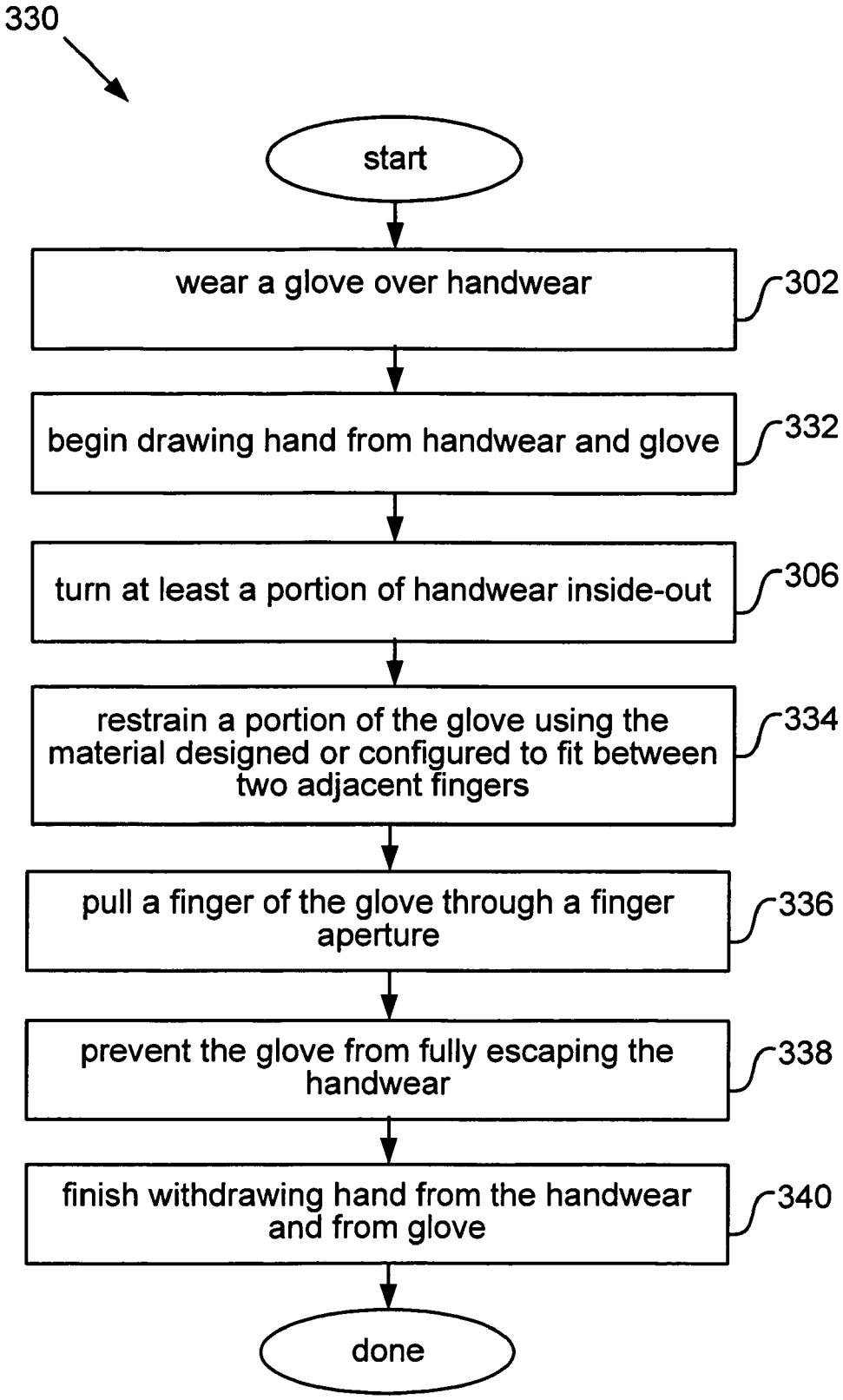
FIG. 3C illustrates a process flow for doffing apparel in accordance with a specific embodiment of the invention.

FIG. 3C illustrates a process flow 330 for doffing protective apparel in accordance with another embodiment of the invention. In this case, process flow 330 expands process flow 300 of FIG. 3A to include an exemplary set of conditions between handwear and a glove in accordance with a specific embodiment of the present invention.

Process flow 330 similarly starts with wearing a glove over handwear that attaches to a sleeve (302 of process flow 300) and proceeds when the person begins to withdraw their hand from the handwear and from the glove (332). Before the person finishes withdrawing their hand from the handwear (340), they turn at least a portion of the handwear inside-out (306 of process flow 300).

The handwear includes material designed or configured to fit between two adjacent fingers of the person when the person wears the handwear. As the handwear turns inside-out, the material designed or configured to fit between two adjacent fingers restrains a portion of the glove (334). Commonly, glove material between the person's fingers or in the vicinity of this area is restrained by the handwear material. As mentioned above, there are four such places this may occur for a five fingered glove. In addition, a main portion of the inside-out handwear may act as a pocket that contains the glove, thus providing a barrier layer between the glove and person. The glove may also be inside-out within the handwear to further reduce exposure between the person and previously outer surfaces of the handwear.

Doffing may also include pulling a glove finger inside-out through a finger aperture included in the handwear (336), which may add to restraint of the glove provided by the handwear. In this case, handwear material between the two adjacent fingers prevents a first glove finger that has traveled into a first finger receptor of the handwear from moving into a second adjacent finger receptor when pulling the glove and handwear inside-out. Likewise, the handwear material between the two adjacent fingers prevents a second glove finger that has traveled into a second finger receptor from moving into the first adjacent finger receptor. In effect, the handwear material between the two adjacent fingers traps glove fingers in their respective apertures—and further restrains material in the glove from movement (the entire glove would need to escape a single finger aperture to escape the handwear, which cannot happen as long as two fingers are trapped in two apertures).

It is understood that one or more glove fingers may be pulled inside-out in this manner while others for a common hand withdrawal may not. For example, two fingers may be pulled inside out while two remain bundled and within the inside-out handwear. For the tubular handwear of FIG. 1B, process flow 330 may also comprise turning a tubular finger sleeve inside-out. Material in the tubular finger sleeve then also adds to the material in the handwear that restricts the movement of the glove.

One or more of these glove restraint and finger trapping instances between the handwear and glove may restrain and trap the outer glove (338) when both the handwear and glove are inside-out, thereby preventing the inside-out glove from fully escaping the inside-out handwear. In this manner, portions of the outer glove may also remain contained within the inside-out handwear. In other cases, such as when each glove finger remains within the handwear, the entire glove may be restrained and contained within the glove.

Process flow 330 ends when the person finishes withdrawing their hand from the handwear and from the glove (340). If glove fingers are pulled through apertures in the handwear, then the last contact between the person and glove and between the person and handwear will typically be with a finger and inside-out glove finger.

Pulling the handwear inside-out thus forms a pocket to contain and trap the glove. It is common for a latex glove to be taped or otherwise attached to a sleeve during usage and before doffing. During doffing, the glove and attached sleeve are often pulled relative to one another during withdrawal of the hand from the glove. This strains the tape, and if enough force is applied, separates the tape from the sleeve or glove. If the glove is elastic (e.g., latex) and has been stretched in this process, the separation may lead to elastic recoil of the glove and unpredictable relationships between outer surfaces of the glove and the person. Handwear and methods of the present invention also reduce the unpredictability of tape separation and elastic recoil for an outer glove. More specifically, handwear of the present invention may contain a glove, regardless of whether tape adherence fails, and thus reduce unpredictability of the situation by containing the glove within the inside-out handwear pocket.

The present invention finds broad use in protective apparel applications. There are numerous applications in which a health-care practitioner or another individual benefits from protective apparel that is used to shield the person from an airborne, liquid or droplet based agent. For example, health care practitioners treating individuals that generate a biological agent, such as a virus associated with a respiratory illness (e.g., the virus believed to be responsible for SARS), often benefit from full coverage protective apparel. Alternatively, surgeons and other surgical staff in an operating room may employ protective apparel that only covers upper portions of their body to defend from splash threats.

Disposable latex gloves are commonly used in hospitals and the present invention is useful in any application where the disposable gloves are employed. In some applications, practitioners may wear an inner second latex glove under the handwear, thereby forming a latex glove/handwear/latex glove combination. The second pair of latex gloves then remains on the person's hands after they doff the handwear and outer glove and may be useful to protect their hands after the apparel has been doffed. Industrial and chemical applications also frequently employ apparel and gloves that may benefit from the present invention.

Although the present invention has been described with respect to a particular garment assembly as described with respect to apparel 10 of FIG. 2, it is understood that handwear 100 may be used with any protective apparel and is not limited to the specific design described above. For example, larger suits such as full protection suits for use in chemical and radiation protection may benefit from the present invention. In addition, garments used in the medical industry that provide less than full body protection may also benefit from the present invention. These medical garments include surgical suits, robes, gowns and long sleeve shirts for example. In addition, it is contemplated that the present invention is also useful with apparel that only includes a sleeve and handwear, or other lesser coverage forms of protection that do not cover portions of the torso.

Although the foregoing invention has been described in some detail for purposes of clarity of understanding, those skilled in the art will recognize that various modifications may be made within the scope of the appended claims. For example, although handwear described herein has included full coverage for the non-finger part of the hand, the present invention is not limited to such designs and may include strips of material or strings that attach to a wrist cuff and include apertures for the fingers to slip through. In addition, apparel 10 may include an aperture in the back of body portion 12 for donning and doffing. The aperture may be opened and closed with a zipper and the zipper for example. The invention is, therefore, not limited to the specific features and embodiments described herein and claimed in any of its forms or modifications within the scope of the appended claims.

What is claimed is:

1. A method of doffing protective apparel, the method comprising:

wearing a fingered glove over handwear attached to a distal portion of a sleeve that covers at least a portion of an arm of a person, the handwear including material configured to fit between two adjacent fingers of the person when the person wears the handwear;

withdrawing a hand from the handwear and from the glove;

turning at least a portion of the handwear inside-out; and restraining a portion of the glove using the handwear.

2. The method of claim 1 further comprising pulling the handwear within the sleeve.

3. The method of claim 1 wherein the material configured to fit between two adjacent fingers restrains the portion of the glove.

4. The method of claim 1 wherein the portion of the glove is restrained within the handwear when the portion of the handwear is inside-out.

5. The method of claim 1 further comprising turning at least a portion of the sleeve inside-out.

6. The method of claim 1 further comprising applying tape to couple the glove to an outer surface of the sleeve before withdrawing the hand from the glove.

7. The method of claim 1 wherein the glove comprises a stretchable material that conforms to the shape of the person's hand.

8. The method of claim 7 wherein the stretchable material constricts a portion of the hand.

9. The method of claim 1 wherein the handwear comprises multiple finger receptors, each finger receptor comprising an aperture and configured to receive a finger of the person through the aperture when the person wears the handwear.

10. The method of claim 9 further comprising pulling a finger of the glove through a finger aperture included in the handwear.

11. The method of claim 9 wherein each finger receptor comprises flaccid material arranged to form a substantially tubular sleeve that defines the aperture through which the person's finger passes when the person wears the handwear.

12. The method of claim 1 further comprising handling a surface of the sleeve that was internal before doffing to dispose of the apparel.

13. A method of doffing protective apparel, the method comprising:

wearing a fingered glove over handwear attached to a distal portion of a sleeve that covers at least a portion of an arm of a person, the handwear including material configured to fit between two adjacent fingers of the person when the person wears the handwear;

pulling the handwear within the sleeve;

withdrawing a hand from the handwear and from the glove;

turning at least a portion of the handwear inside-out; and restraining a portion of the glove using the material configured to fit between two adjacent fingers.

14. The method of claim 13 wherein the material configured to fit between two adjacent fingers prevents the glove from escaping the handwear.

15. The method of claim 13 wherein the glove comprises a stretchable material that conforms to the shape of the person's hand.

16. A method of doffing protective apparel, the method comprising:

wearing a fingered glove over handwear attached to a distal portion of a sleeve that covers at least a portion of an arm of a person, the handwear including material configured to fit between two adjacent fingers of the person when the person wears the handwear;

withdrawing a hand from the handwear and from the glove;

turning at least a portion of the handwear inside-out; and restraining a portion of the glove using the handwear using the material configured to fit between two adjacent fingers when the portion is inside-out.

17. The method of claim 16 further comprising pulling a finger of the glove through a finger aperture included in the handwear.

18. The method of claim 16 wherein the material configured to fit between two adjacent fingers prevents a first glove finger in a first adjacent finger receptor from moving into a second adjacent finger receptor when pulling the portion of the handwear inside-out

19. The method of claim 16 wherein each finger receptor comprises flaccid material arranged to form a substantially tubular sleeve that defines the aperture through which the person's finger passes when the person wears the handwear.

20. The method of claim 10 further comprising pulling a substantially tubular sleeve inside-out.

* * * * *